US012180963B2

(12) United States Patent
Firlefijn

(10) Patent No.: US 12,180,963 B2
(45) Date of Patent: Dec. 31, 2024

(54) METHOD FOR DETECTING AND MONITORING CONDENSATE IN AN OIL SYSTEM OF AN OIL-INJECTED COMPRESSOR OR VACUUM PUMP

(71) Applicant: ATLAS COPCO AIRPOWER, NAAMLOZE VENNOOTSCHAP, Wilrijk (BE)

(72) Inventor: Jeroen Alois M. Firlefijn, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 0 days.

(21) Appl. No.: 18/280,605

(22) PCT Filed: Mar. 1, 2022

(86) PCT No.: PCT/EP2022/055037
§ 371 (c)(1),
(2) Date: Sep. 6, 2023

(87) PCT Pub. No.: WO2022/189192
PCT Pub. Date: Sep. 15, 2022

(65) Prior Publication Data

US 2024/0151230 A1 May 9, 2024

(30) Foreign Application Priority Data

Mar. 9, 2021 (BE) ..... 2021/5178

(51) Int. Cl.
*F04C 29/04* (2006.01)
*F04B 39/06* (2006.01)
(Continued)

(52) U.S. Cl.
CPC ..... *F04C 28/28* (2013.01); *F04C 18/16* (2013.01); *F04C 29/026* (2013.01); *F04C 29/04* (2013.01);
(Continued)

(58) Field of Classification Search
CPC ..... F04C 29/0007; F04C 28/28; F04C 18/18; F04C 29/021; F04C 29/026; F04C 29/04; F04C 29/0041; F04B 39/062; G01K 1/026
See application file for complete search history.

(56) References Cited

U.S. PATENT DOCUMENTS

| | | | | |
|---|---|---|---|---|
| 11,092,156 | B2 * | 8/2021 | Moens | F04C 29/0014 |
| 2004/0217180 | A1 | 11/2004 | Lu | |
| 2015/0030468 | A1 * | 1/2015 | Martens | F04B 39/062 417/53 |

FOREIGN PATENT DOCUMENTS

| | | | | |
|---|---|---|---|---|
| EP | 2 527 656 | A2 | 11/2012 | |
| EP | 3315780 | B1 * | 12/2018 | F01P 3/20 |
| TW | I 635 221 | B | 9/2018 | |

OTHER PUBLICATIONS

English translation of EP 3315780 by PE2E Mar. 1, 2024.*
(Continued)

*Primary Examiner* — Deming Wan
(74) *Attorney, Agent, or Firm* — Sughrue Mion, PLLC

(57) ABSTRACT

A computer-implemented method for detecting condensate in an oil system of a compressor, having an inlet and an outlet. The method incudes the steps of: determining the humidity at the inlet and at the outlet or downstream of the outlet of the compressor; determining the amount of water vapor that enters and exits the compressor based on the humidity determined at the inlet and the outlet or downstream of the outlet; determining the amount of condensate that remains in the compressor by determining the difference
(Continued)

between the amount of condensate that enters and exits the compressor; storing the amount of condensate that remains; and repeating the aforementioned steps at regular intervals and storing the amount of condensate and how long said condensate remains in the compressor.

23 Claims, 1 Drawing Sheet

(51) Int. Cl.

| | |
|---|---|
| ***F04C 18/16*** | (2006.01) |
| ***F04C 28/28*** | (2006.01) |
| ***F04C 29/00*** | (2006.01) |
| ***F04C 29/02*** | (2006.01) |
| ***G01K 1/02*** | (2021.01) |

(52) U.S. Cl.
CPC .... *F04C 2220/10* (2013.01); *F04C 2270/195* (2013.01); *F04C 2270/24* (2013.01); *F04C 2270/42* (2013.01); *F04C 2270/44* (2013.01)

(56) References Cited

OTHER PUBLICATIONS

International Search Report for PCT/EP2022/055037 dated May 23, 2022.
Written Opinion for PCT/EP2022/055037 dated May 23, 2022.

* cited by examiner

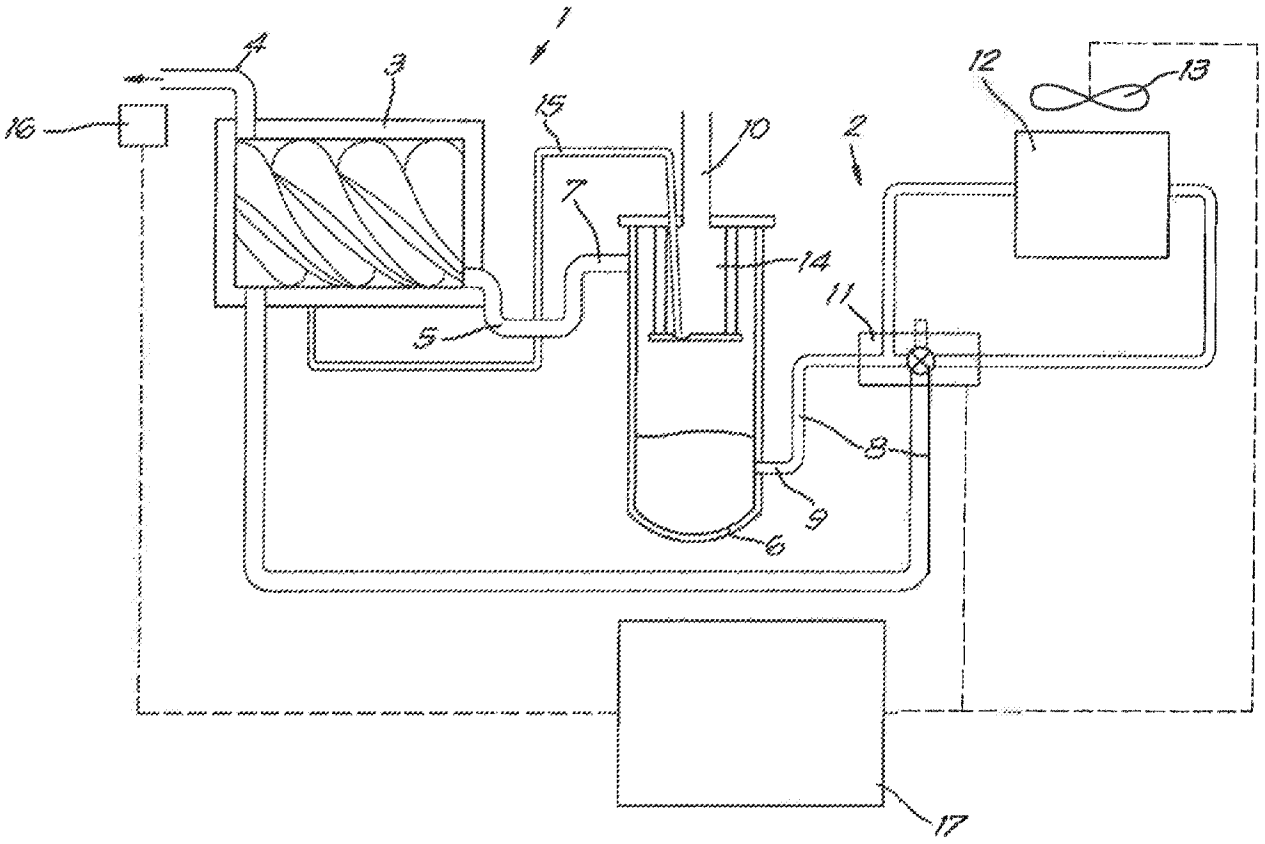
1
2
3
4
5
6
7
8
9
10
11
12
13
14
15
16
17

METHOD FOR DETECTING AND MONITORING CONDENSATE IN AN OIL SYSTEM OF AN OIL-INJECTED COMPRESSOR OR VACUUM PUMP

CROSS REFERENCE TO RELATED APPLICATIONS

This application is a National Stage of International Application No. PCT/EP2022/055037 filed Mar. 1, 2022, claiming priority based on Belgium Patent Application No. BE2021/5178 filed Mar. 9, 2021.

The present invention relates to a method for detecting and monitoring condensate in an oil system of an oil-injected compressor or vacuum pump.

In particular, the invention is intended to be able to detect the occurrence of condensate in the oil circuit of an oil-injected compressor or vacuum pump.

An oil-injected compressor takes in and subsequently compresses ambient air. Because said ambient air has a certain humidity, it contains water that can condense after compression.

Because oil is injected into the machine during compression, an air/oil mixture forms at the outlet of the machine, possibly with unwanted condensate or water.

The air is typically separated from the oil and any water present in an oil separator, which oil and water are recovered and return to the oil circuit.

This means that the oil and any water present are reinjected into the compressor.

It is known that the presence of water in the oil and the oil circuit has a negative impact on the life of the oil and on the operation of the compressor.

Therefore, it is important to limit the presence of condensate in the air/oil mixture at the outlet of the machine as much as possible so that only the oil is separated when the air is separated in the oil separator.

Controlling the compressor involves keeping the temperature at the outlet of the compressor high enough to avoid the occurrence of condensate. This is achieved by keeping the temperature of the oil that is injected high enough.

In this case, a worst-case scenario is traditionally assumed, a relative humidity of 100% being presumed for the ambient air, i.e., a worst-case scenario for the occurrence of condensate in the air/oil mixture at the outlet.

As a result, the temperature of the oil is higher than necessary to prevent condensate because under normal circumstances a worst-case to scenario is not experienced. Such controlling is not only less energy-efficient, but also unnecessarily reduces the life of the oil.

Moreover, in some cases, for example when cold booting the compressor, condensate ends up in the oil in any case, regardless of whether the controlling takes a worst-case scenario into account.

The object of the present invention is to provide a solution to at least one of the aforementioned disadvantages and other disadvantages by providing a method that allows condensate to be detected and monitored in an oil system of an oil-injected compressor or vacuum pump.

The present invention relates to a computer-implemented method for detecting and monitoring condensate in an oil system of an oil-injected compressor or vacuum pump, having an inlet for air to be compressed and an outlet for compressed air, the method comprising the following steps:

determining the humidity at the inlet and at the outlet or downstream of the outlet of the compressor or vacuum pump;

determining the amount of water vapor that enters the compressor or vacuum pump and the amount of condensate that exits the compressor or vacuum pump based on the humidity determined at the inlet and the outlet or downstream of the outlet;

determining the amount of condensate that remains in the compressor or vacuum pump by determining the difference between the amount of condensate that enters the compressor or vacuum pump and the amount of condensate that exits the compressor or vacuum pump;

storing or keeping track of the amount of condensate that remains;

repeating or continuously carrying out the aforementioned steps at regular intervals and storing or keeping track of the amount of condensate and how long said condensate remains in the compressor or vacuum pump.

In this case, "monitoring condensate" means keeping track of the amount of condensate and how long said condensate remains in the compressor.

In this case, "oil system" refers to an oil circuit or to an oil injection circuit of the oil-injected compressor.

In this case, "storing or keeping track of the amount of condensate" does not mean that the physical condensate is kept track of, but only that the numerical value representing the amount of condensate is kept track of in a list, database or the like.

In this case, "keeping track of how long said condensate remains" means that the time span (expressed in a unit of time such as the number of seconds, minutes, hours or the like) is kept track of in a list, database or the like.

One advantage is that, by determining the amount of condensate that remains in the compressor or vacuum pump, this information can be used meaningfully to control the compressor or vacuum pump instead of having to assume a worst-case scenario.

In other words, the temperature of the oil can be regulated based on the actual situation instead of a worst-case scenario.

A further advantage is that, based on the information relating to the amount of condensate and how long said condensate remains in the compressor or vacuum pump, it is also possible to deduce when the oil will need to be replaced and when the compressor or vacuum pump will need to be maintained or inspected.

The method preferably comprises the step of regulating the temperature of the oil of the oil system based on the amount of condensate that remains and how long the condensate remains in the compressor or vacuum pump in order to regulate the temperature at the outlet of the compressor or vacuum pump.

This has the advantage that the temperature at the outlet can be kept high enough to prevent condensate but at the same time the temperature does not need to be kept unnecessarily high by taking into account the determined or calculated amount of condensate that remains, as a result of which the worst-case scenario does not need to be assumed.

In a preferred embodiment, the temperature of the oil of the oil system is regulated by controlling the speed of a cooling fan, the amount of cooling water in a water cooler, the position of a thermostatic valve, whereby the cooling fan, water cooler and/or thermostatic valve form part of the oil system.

Of course, the invention is not limited to this and various means can be applied to regulate the temperature of the oil of the oil system.

Preferably, before the step of determining the humidity at the outlet or downstream of the outlet of the compressor or vacuum pump, the humidity is determined in an oil separator downstream of the outlet of the compressor.

The oil separator is the location where the condensed water can end up in the separated oil.

The invention also relates to a system for detecting and monitoring condensate in an oil system of an oil-injected compressor or vacuum pump, the system comprising a processing unit configured to carry out the computer-implemented method according to the invention.

The invention also relates to a computer program product containing instructions that can be executed on a computer in order to carry out the method according to the invention by executing said program on a computer.

Furthermore, the invention relates to a storage medium readable by a computer and containing the computer program product according to the invention.

It goes without saying that the aforementioned system, computer program product and computer-readable storage medium have the same advantages as the method according to the invention.

The invention also relates to a method method according to any of claims 14 to 23 or any combination thereof, which method has the same advantages as the computer-implemented invention according to the invention.

In order to better illustrate the features of the invention, some preferred applications of the computer-implemented method according to the invention for detecting and monitoring condensate in an oil system of an oil-injected compressor or vacuum pump are described below as examples without any limiting character with reference to the attached drawings, in which: Figure schematically shows an oil-injected compressor.

The oil-injected compressor 1 shown in Figure is shown with an oil system 2.

Although reference is made below to a compressor 1, the invention is also applicable to a vacuum pump. When reference is made below to a compressor 1, a "compressor 1 or vacuum pump" is meant.

The oil-injected compressor 1 is also provided with a drive (not shown in the figure).

In this case, but not necessarily, the compressor 1 is a screw compressor 3.

In this case, said compressor 1 comprises only one compressor element 3, but it is not ruled out that the compressor 1 comprises a plurality of compressor elements 3 placed in series or in parallel.

The compressor 1 has an inlet 4 for gas to be compressed and an outlet for compressed gas.

In this case, the oil system 2 comprises an oil separator 6, which is connected with its input 7 to said outlet 5, an oil injection line 8, which runs from a first output 9 for oil of the oil separator 6 to the compressor 1, where it provides for oil injection.

The oil separator 6 also comprises a second output 10 for purified air.

A thermostatic valve 11 is accommodated in the injection line 8, which thermostatic valve can at least in part divert the separated oil from the oil separator 6 by means of a heat exchanger 12.

In this case, the heat exchanger 12 is an oil/air heat exchanger 12 and is provided with a cooling fan 13.

In this case, the oil separator 6 is the type that separates oil from the air by means of cyclone separation. In this case, but not necessarily, the oil separator 6 also comprises a filter element 14 for purifying the compressed air a second time after the cyclone separation and a small discharge line 15 that runs from the filter element 14 in the oil separator 6 to the compressor 1, where it provides for a separate injection point.

The compressor 1 also comprises sensors 16 that can measure the inlet conditions or environmental parameters.

Examples of said environmental parameters include, but are not limited to, the temperature, pressure and humidity.

The compressor 1 also comprises a control unit 17, which is connected to the aforementioned sensors 16 so that it can read them out and to the thermostatic valve 11 and the cooling fan 13 so that it can control them.

Although in this case the sensors 16 form part of the compressor 1, it is not ruled out that the control unit 17 is connected to sensors 16 of another nearby compressor 1, which sensors can measure or determine the environmental parameters.

As will be illustrated later, the control unit 17 is configured to be able to carry out a method according to the invention.

The operation and control of the compressor 1 according to a method of the invention is very simple and as follows.

The compressor 1 is driven by a drive and, by means of the screw compressor 3, air is taken in via the inlet 4, which air is compressed by the screw compressor 3, after which the compressed air exits the screw compressor 3 via the outlet 5.

During operation, oil is injected into the screw compressor 3 via the aforementioned injection line 8 and discharge line 15 for the lubrication, cooling and sealing of the screw compressor.

In this case, the injection can, as is known, take place at the screw rotors, bearings, etc.

It is also possible for oil injection to take place in the aforementioned drive.

As a result of the oil injection, the compressed air contains a certain amount of oil at the outlet 5.

This oil/air mixture reaches the oil separator 6, where the oil is separated from the compressed air.

In this case, the oil separator 6 purifies the air by means of two steps, cyclone separation and a filter element 14. However, it is clear that the oil separator 6 can also be of a different type.

The purified air exits the oil separator 6 via the second output 10 provided for this purpose.

The separated oil is collected in the oil separator 6.

The oil is returned to the compressor 1 via the injection line 8.

The oil is cooled here. Because the temperature of the oil affects the operating temperature of the compressor 1 and, consequently, the occurrence of condensate, a method according to the invention is applied in order to regulate this cooling.

The control unit 17 carries out the steps of the method.

According to the invention, the method consists of carrying out the following steps:

to A) determining the humidity at the inlet 4 and at the outlet 5 or downstream of the outlet 5 of the compressor 1;

B) determining the amount of water vapor that enters the compressor 1 and the amount of condensate that exits the compressor 1 based on the humidity determined at the inlet 4 and the outlet 5 or downstream of the outlet 5;

C) determining the amount of condensate that remains in the compressor 1 by determining the difference between the amount of condensate that enters the compressor 1 and the amount of condensate that exits the compressor 1;

D) storing or keeping track of the amount of condensate that remains;

E) repeating or continuously carrying out the aforementioned steps at regular intervals and keeping track of the amount of condensate and how long said condensate remains in the compressor 1.

In this case, environmental parameters, which are determined or calculated by means of the aforementioned sensors 16, are used to determine the humidity at the inlet 4 of the compressor 1 in step A. It is possible for both the relative and absolute humidity to be determined in step A.

It is possible that, instead of the aforementioned sensors 16, sensors 16 in another machine or device, which is located in the vicinity of the aforementioned oil-injected compressor 1, are used.

A software agent configured to retrieve weather information can also be used. An example of such a software agent is a weather application programming interface or weather API. The location of the compressor 1 can improve the information retrieved.

Determining the humidity at the outlet 5 or downstream of the outlet 5 of the compressor in step A is done by calculating said humidity based on the humidity at the inlet 4 of the compressor 1 and using physics formulas. Here, it is again possible for the relative or absolute humidity to be determined.

In this case, the humidity is determined downstream of the outlet 5, in particular in the oil separator 6.

Indeed, this is the exact location where it is desirable to avoid condensate at all times. Choosing this location makes it possible to work very accurately.

In addition to the relative or absolute humidity at the inlet 4 of the compressor 1 and physics formulas, it is not ruled out that use is also made of the conditions of the gas, such as the temperature and the pressure at this location, if the necessary sensors 16 are provided for this purpose.

For step B, determining the amount of moisture that enters and exits the compressor 1, the known formulas are used.

For steps D and E, which comprise keeping track of how much condensate remains in the compressor 1 and for how long, there are various options.

This step preferably comprises keeping track of the amount of condensate and how long said condensate remains in the compressor 1 in a histogram.

This has the advantage that said histogram can be used to make certain decisions. This means that, based on the histogram or the information contained therein, certain actions can be carried out.

The method preferably also comprises the step of regulating the temperature of the oil of the oil system 2 based on the amount of condensate that remains and how long the condensate remains in the compressor 1 (i.e., based on the information in the aforementioned histogram) in order to regulate to the temperature at the outlet 5 or downstream of the outlet 5 of the compressor 1.

In this case, the temperature in the oil separator 6 is in particular regulated, said temperature being regulated so that no condensate can occur in this location.

There are various options for regulating the temperature of the oil.

The temperature of the oil of the oil system 2 is, in this case, regulated by the control unit 17 by controlling the speed of the cooling fan 13 and the status of the aforementioned thermostatic valve 11.

By sending more or less oil through the heat exchanger 12, the oil is to a greater or lesser extent cooled.

In addition, the control unit 17 can regulate the cooling capacity of the heat exchanger 12 by controlling the cooling fan 13.

If the heat exchanger 12 is not an air/oil heat exchanger 12 but a water/oil heat exchanger 12, the control unit 17 can regulate the amount of cooling water.

Of course, it is not ruled out that, for example, only the thermostatic valve 11 or the cooling fan 13 is controlled in order to achieve simpler control.

It is possible to regulate the temperature of the oil of the oil system 2 by controlling the amount of oil that the oil system injects into the compressor 1.

For this purpose, for example, a control valve is provided in the injection line 8, downstream of the thermostatic valve 11, which control valve can regulate the amount of oil that is injected into the compressor 1.

The aforementioned regulation of the temperature of the oil in the oil system 2 by the control unit 17 can ensure that the operating temperature of the compressor 1 is high enough to prevent the occurrence of condensate in the oil separator 6.

It can also be ensured that the operating temperature is not unnecessarily high because the regulation is based on effective, actual parameters.

Instead of the method comprising the step of regulating the temperature of the oil in the oil system 2, it is possible for the method to comprise the step of regulating the temperature of the air at the outlet 5 or downstream of the outlet 5 based on the amount of condensate that remains and how long the condensate remains in the compressor 1.

Although in the aforementioned example the steps of the method are carried out by the control unit 17, it is not ruled out that an application or program in the cloud is used to carry out the steps of the method.

The present invention is in no way limited to the embodiments described by way of example and shown in the drawings. Rather, such a computer-implemented method for detecting and monitoring condensate in an oil system of an oil-injected compressor or vacuum pump can be achieved according to different variants without departing from the scope of the invention.

The invention claimed is:

1. A computer-implemented-method for detecting and monitoring condensate in an oil system (2) of an oil-injected compressor (1) or vacuum pump, having an inlet (4) for air to be compressed and an outlet (5) for compressed air, wherein the method comprises the following steps:

determining a humidity at the inlet (4) and at the outlet (5) or downstream of the outlet (5) of the compressor (1) or vacuum pump;

determining an amount of water vapor that enters the compressor (1) or vacuum pump and amount of condensate that exits the compressor (1) or vacuum pump based on the humidity determined at the inlet (4) and the outlet (5) or downstream of the outlet (5);

determining an amount of condensate that remains in the compressor (1) or vacuum pump by determining the difference between the amount of condensate that enters the compressor (1) or vacuum pump and the amount of condensate that exits the compressor (1) or vacuum pump;

storing or keeping track of the amount of condensate that remains;

repeating or continuously carrying out the aforementioned steps at regular intervals and storing or keeping track of the amount of condensate and how long said condensate remains in the compressor or vacuum pump.

2. The computer-implemented method according to claim 1, wherein the method comprises the step of regulating the temperature of the oil of the oil system (2) based on the amount of condensate that remains and how long the condensate remains in the compressor (1) or vacuum pump in order to regulate the temperature at the outlet (5) or downstream of the outlet (5) of the compressor (1) or vacuum pump.

3. The computer-implemented method according to claim 2, wherein the temperature of the oil of the oil system (2) is regulated by controlling the speed of a cooling fan (13), the amount of cooling water in a water cooler and/or the position of a thermostatic valve (11), whereby the cooling fan (13), water cooler and/or thermostatic valve (11) form part of the oil system (2).

4. The computer-implemented method according to claim 2, wherein the temperature of the oil of the oil system (2) is regulated by controlling the amount of oil that the oil system injects into the compressor (1) or vacuum pump.

5. The computer-implemented method according to claim 1, wherein the method comprises the step of regulating the temperature of the air at the outlet (5) or downstream of the outlet (5) based on the amount of condensate that remains and how long the condensate remains in the compressor (1) or vacuum pump.

6. The computer-implemented method according to claim 1, wherein, to determine the humidity at the inlet (4) of the compressor (1) or vacuum pump, environmental parameters are used, which are determined or calculated by means of:

sensors (16) in the oil-injected compressor (1) or vacuum pump; and/or sensors (16) in another machine located in the vicinity of said oil-injected compressor (1) or vacuum pump; and/or a software agent configured to retrieve weather information, possibly supplemented by the location of the compressor (1) or vacuum pump.

7. The computer-implemented method according to claim 1, wherein determining the humidity at the outlet (5) or downstream of the outlet (5) of the compressor (1) or vacuum pump is done by calculating said humidity based on the humidity at the inlet (4) of the compressor (1) or vacuum pump and using physics formulas.

8. The computer-implemented method according to claim 1, wherein, to carry out the steps of the method, an application or program in the cloud is used.

9. The computer-implemented method according to claim 1, wherein the method comprises the step of keeping track of the amount of condensate and how long said condensate remains in the compressor (1) or vacuum pump in a histogram.

10. The computer-implemented method according to claim 1, wherein, to determine the humidity at the outlet (5) or downstream of the outlet (5) of the compressor (1), the humidity is determined in an oil separator (6) downstream of the outlet (5) of the compressor (1).

11. A system for detecting and monitoring condensate in an oil system (2) of an oil-injected compressor (1) or vacuum pump, the system comprising a processing unit configured to carry out the computer-implemented method according to claim 1.

12. A computer program product containing instructions that can be executed on a computer in order to carry out the method according to claim 1 by executing said program on a computer.

13. A storage medium readable by a computer and containing the computer program product according to claim 12.

14. A method for detecting and monitoring condensate in an oil system (2) of an oil-injected compressor (1) or vacuum pump, having an inlet (4) for gas to be compressed and an outlet (5) for compressed gas, wherein the method comprises the following steps:

determining a humidity at the inlet (4) and at the outlet (5) or downstream of the outlet (5) of the compressor (1) or vacuum pump;

determining an amount of water vapor that enters the compressor (1) or vacuum pump and amount of condensate that exits the compressor (1) or vacuum pump based on the humidity determined at the inlet (4), on the one hand, and at the outlet (5) or downstream of the outlet (5), on the other hand;

determining an amount of condensate that remains in the compressor (1) or vacuum pump by determining the difference between the amount of condensate that enters the compressor (1) or vacuum pump and the amount of condensate that exits the compressor (1) or vacuum pump;

storing or keeping track of the amount of condensate that remains in the compressor (1) or vacuum pump;

repeating or continuously carrying out the aforementioned steps at regular intervals and storing or keeping track of the amount of condensate and how long said condensate remains in the compressor (1) or vacuum pump.

15. The method according to claim 14, wherein the method comprises the step of regulating the temperature of the oil in the oil system (2), based on the amount of condensate that remains in the compressor (1) or vacuum pump and on the amount of time which the condensate remains in the compressor (1) or vacuum pump in order to regulate the temperature at the outlet (5) or downstream of the outlet (5) of the compressor (1) or vacuum pump.

16. The method according to claim 15, wherein the temperature of the oil in the oil system (2) is regulated by controlling the speed of a cooling fan (13), the flow of cooling water in a water cooler and/or the position of a thermostatic valve (11), whereby the cooling fan (13), water cooler and/or thermostatic valve (11) form part of the oil system (2).

17. The method according to claim 15, wherein the temperature of the oil in the oil system (2) is regulated by controlling the amount of oil that the oil system injects into a compressor element or vacuum pump element that makes part of said compressor (1) or vacuum pump.

18. The method according to claim 14, wherein the method comprises the step of regulating the temperature of the air at the outlet (5) or downstream of the outlet (5) based on the amount of condensate that remains in the compressor (1) or vacuum pump and on the amount of time that the condensate remains in the compressor (1) or vacuum pump.

19. The method according to claim 14, wherein, in order to determine the humidity at the inlet (4) of the compressor (1) or vacuum pump, environmental parameters are used, which are determined or calculated by means of:

sensors (16) in the oil-injected compressor (1) or vacuum pump; and/or sensors (16) in another machine located in the vicinity of said oil-injected compressor (1) or vacuum pump; and/or a software agent configured to retrieve weather information, possibly supplemented by the location of the compressor (1) or vacuum pump.

20. The method according to claim 14, wherein determining the humidity at the outlet (5) or downstream of the outlet (5) of the compressor (1) or vacuum pump is done by calculating said humidity based on the humidity at the inlet (4) of the compressor (1) or vacuum pump and using physics formulas.

21. The method according to claim 14, wherein, to carry out the steps of the method, an application or program in the cloud is used.

22. The method according to claim 14, wherein the method comprises the step of keeping track of the amount of condensate and how long said condensate remains in the compressor (1) or vacuum pump in a histogram.

23. The method according to claim 14, wherein, to determine the humidity at the outlet (5) or downstream of the outlet (5) of the compressor (1), the humidity is determined in an oil separator (6) positioned downstream of the outlet (5) of the compressor (1).

* * * * *